US011647884B2

(12) United States Patent
Iwakami

(10) Patent No.: US 11,647,884 B2
(45) Date of Patent: May 16, 2023

(54) CLEANER

(71) Applicant: MAKITA CORPORATION, Anjo (JP)

(72) Inventor: Junichi Iwakami, Anjo (JP)

(73) Assignee: MAKITA CORPORATION, Anjo (JP)

( * ) Notice: Subject to any disclaimer, the term of this patent is extended or adjusted under 35 U.S.C. 154(b) by 933 days.

(21) Appl. No.: 16/512,564

(22) Filed: Jul. 16, 2019

(65) Prior Publication Data

US 2020/0037839 A1 Feb. 6, 2020

(30) Foreign Application Priority Data

Aug. 1, 2018 (JP) ..... JP2018-145360

(51) Int. Cl.

*A47L 9/28* (2006.01)
*A47L 5/24* (2006.01)
*A47L 9/32* (2006.01)

(52) U.S. Cl.

CPC ..... *A47L 9/2863* (2013.01); *A47L 5/24* (2013.01); *A47L 9/322* (2013.01)

(58) Field of Classification Search

CPC ..... A47L 9/2863; A47L 5/24; A47L 9/322; A47L 9/2857; A47L 5/02; A47L 9/10; A47L 9/1658; A47L 9/28; A47L 9/2836; A47L 9/2868; A47L 9/2884

See application file for complete search history.

(56) References Cited

U.S. PATENT DOCUMENTS

| | | | | |
|---|---|---|---|---|
| 6,610,946 | B2 * | 8/2003 | Covell | H01H 9/06 200/332.2 |
| 7,322,427 | B2 | 1/2008 | Shimma et al. | |
| 10,743,733 | B2 | 8/2020 | Stickney | |
| 2006/0011361 | A1 | 1/2006 | Shimma et al. | |
| 2017/0209014 | A1 * | 7/2017 | Stickney | A47L 9/322 |

FOREIGN PATENT DOCUMENTS

| | | | |
|---|---|---|---|
| JP | S6364334 | U | 4/1988 |
| JP | H06-142022 | A | 5/1994 |
| JP | H08-206047 | A | 8/1996 |
| JP | 2001-275907 | A | 10/2001 |
| JP | 2005-137432 | A | 6/2005 |
| JP | 2006-000957 | A | 1/2006 |

(Continued)

OTHER PUBLICATIONS

Dec. 17, 2021 Office Action Issued in Chinese Patent Application No. 201910643743.3.

(Continued)

*Primary Examiner* — David Redding
(74) *Attorney, Agent, or Firm* — Oliff PLC

(57) ABSTRACT

A cleaner includes a main body, a handle, a first switch member, and a second switch member. The main body generates a suction force to suck in dust with air by a motor. The handle is to be held by a user. The first switch member is disposed movably on the handle and switches between supplying and not supplying power to the motor by being moved. The second switch member is disposed movably on the handle and, by being moved, moves the first switch member so as to switch between supplying and not supplying power to the motor.

9 Claims, 11 Drawing Sheets

(56) References Cited

FOREIGN PATENT DOCUMENTS

| | | | |
|---|---|---|---|
| JP | 2008-119755 | A | 5/2008 |
| JP | 2008-544786 | A | 12/2008 |
| JP | 2012-120634 | A | 6/2012 |
| JP | 2014-045786 | A | 3/2014 |
| JP | 2017-127641 | A | 7/2017 |
| JP | 2018-000456 | A | 1/2018 |

OTHER PUBLICATIONS

Apr. 8, 2022 Office Action issued in Chinese Patent Application No. 201910643743.3.
Jul. 28, 2021 Office Action Issued in Chinese Patent Application No. 201910643743.3.

* cited by examiner

CLEANER

CROSS-REFERENCE TO RELATED APPLICATION(S)

The present application claims priority to and incorporates by reference the entire contents of Japanese Patent Application No. 2018-145360 filed in Japan on Aug. 1, 2018.

BACKGROUND OF THE INVENTION

1. Field of the Invention

The present invention relates to a cleaner.

2. Description of the Related Art

There has been known a technology relating to a cleaner whose motor is driven and stopped by operating a trigger-type operation switch (for example, see Japanese Patent Application Laid-open No. 2012-120634). In the technology disclosed in Japanese Patent Application Laid-open No. 2012-120634, the motor is driven when the trigger-type operation system is pulled in by a finger, and the motor is stopped when the finger is released.

In the technology disclosed in Japanese Patent Application Laid-open No. 2012-120634, when the trigger-type operation switch is pulled in, the cleaner is operated while the trigger-type operation switch is being pulled in. Thus, a user can easily and conveniently operate the cleaner. However, for the continuous suction, the user needs to keep pulling in the trigger-type operation switch by his/her finger. As a result, some users may feel burdened.

SUMMARY OF THE INVENTION

An aspect of the present invention has an object to provide a cleaner that are capable of keeping pulling in the trigger-type operation switch even when a finger is released.

A cleaner according to an aspect of the present invention includes a main body, a handle, a first switch member, and a second switch member. The main body generates a suction force to suck in dust with air by a motor. The handle is to be held by a user. The first switch member is disposed movably on the handle and switches between supplying and not supplying power to the motor by being moved. The second switch member is disposed movably on the handle and, by being moved, moves the first switch member so as to switch between supplying and not supplying power to the motor.

BRIEF DESCRIPTION OF THE DRAWINGS

FIG. 4 is a sectional view of the trigger switch and the slide switch of the cleaner according to the first embodiment, and a diagram illustrating a state when the trigger switch is pulled in;

DETAILED DESCRIPTION OF THE PREFERRED EMBODIMENTS

Hereinafter, embodiments of the present invention will be described in detail with reference to the accompanying drawings. However, the present invention is not limited to these embodiments. Moreover, components in the embodiments described below include components that can be easily replaced by those skilled in the art, or components substantially the same as those components. Furthermore, the components described below can be combined with one another as appropriate. Still furthermore, when there are multiple embodiments, the present invention encompasses a configuration including a combination of embodiments.

In the following explanation, an X-axis direction is referred to as a "front-to-rear direction". A Y-axis direction is referred to as a "left-to-right direction". The Y-axis direction is a direction perpendicular to the X-axis direction in a horizontal plane. A left hand side viewed from the "front" side in the front-to-rear direction is "left", and a right hand side toward the "front" side in the front-to-rear direction is "right". A Z-axis direction is referred to as a "vertical direction". The Z-axis direction is a direction perpendicular to the X-axis direction and the Y-axis direction.

First Embodiment

Figure 1:
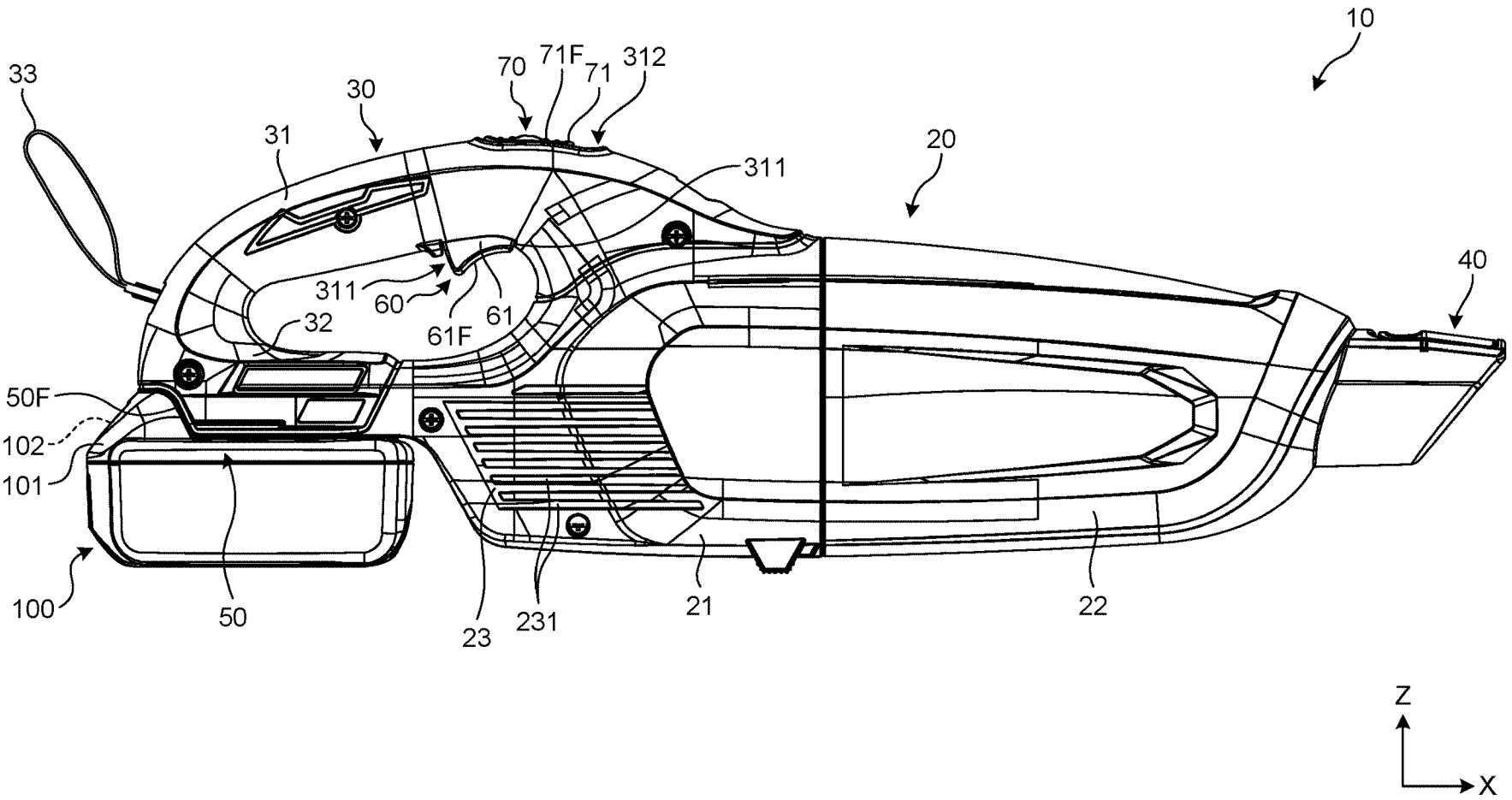
FIG. 1 is a side view of an example of a cleaner according to a first embodiment.
Figure 2:
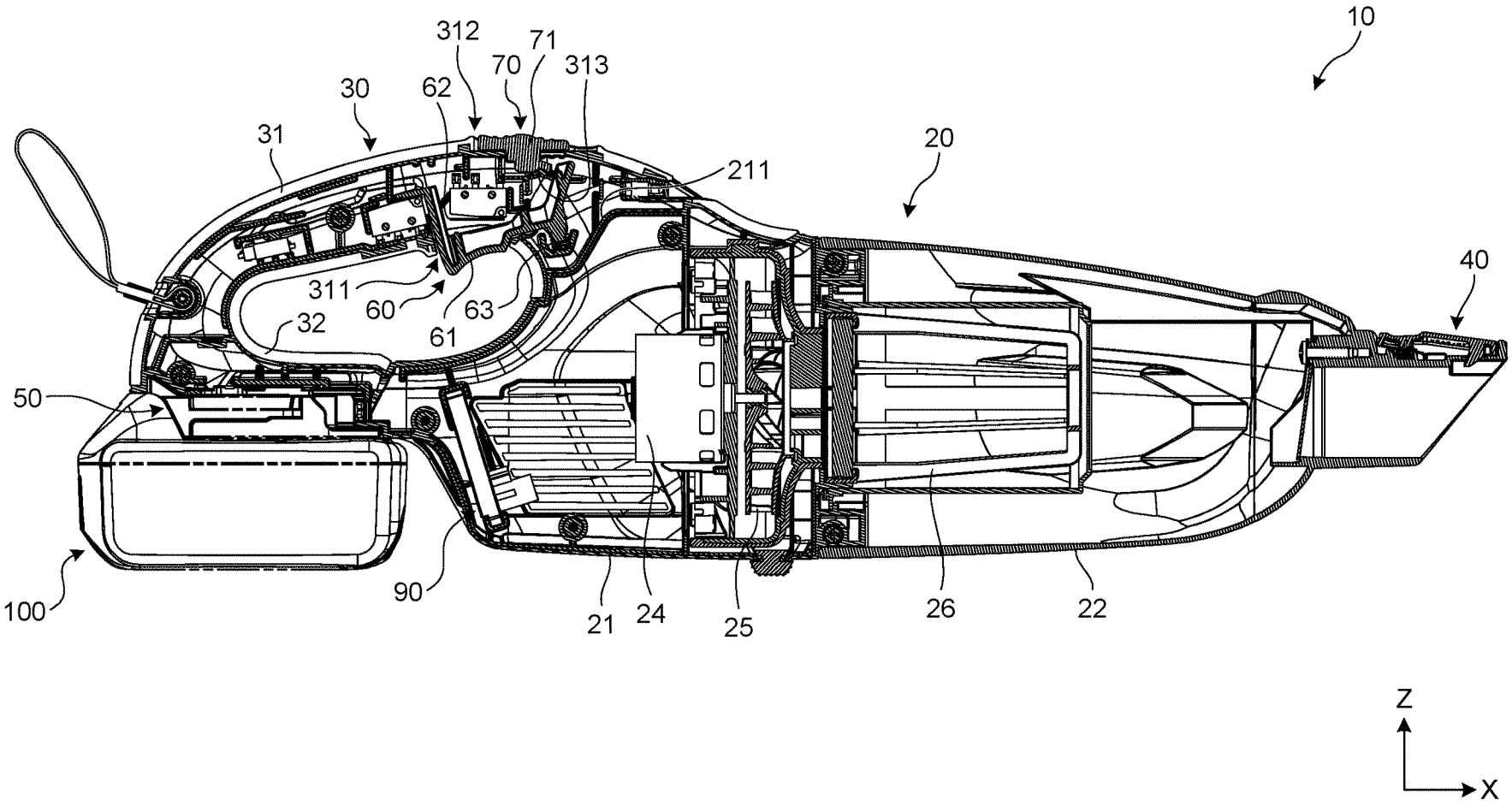
FIG. 2 is a sectional view of an example of the cleaner according to the first embodiment.

An outline of a cleaner 10 will now be described with reference to FIG. 1 and FIG. 2. FIG. 1 is a side view of an example of a cleaner according to a first embodiment. FIG. 2 is a sectional view of an example of the cleaner according to the first embodiment. In the present embodiment, the cleaner 10 is operated when power is supplied from a rechargeable battery pack (hereinafter, referred to as a "battery") 100.

The cleaner 10 includes a main body 20, a handle 30, a suction nozzle 40, a battery mounting part 50, a trigger switch 60, a slide switch 70, a control circuit substrate 90, and the battery 100.

The main body 20 generates a suction force capable of sucking in dust with air. The main body 20 includes a rear housing 21, a front housing 22, an exhaust port 23, a motor 24, a suction fan 25, and a filter 26.

The rear housing 21 defines the external shape of the main body 20, together with the front housing 22. The rear housing 21 is formed in a tubular shape in which the +X side is opened. The rear housing 21 houses therein the motor 24 and the suction fan 25. The rear housing 21 is disposed with the exhaust port 23.

The front housing 22 is formed in a tubular shape in which the −X side is opened. The front housing 22 is attachable to and detachable from the opening of the rear housing 21 on the +X side. The filter 26 is housed in the front housing 22. When the suction fan 25 is driven, the front housing 22 accumulates the dust contained in the air sucked in from the suction nozzle 40. The air that has passed through the front housing 22 passes through the filter 26, and flows into the rear housing 21. In a state in which the front housing 22 is detached from the rear housing 21, it is possible to remove the dust accumulated in the front housing 22.

The exhaust port 23 communicates the outside and the inside of the rear housing 21. The exhaust port 23 discharges the air sucked in from the suction nozzle 40 to the outside of the rear housing 21. The exhaust port 23 includes a plurality of slits 231. In the present embodiment, each of the slits 231 is a long hole formed along the front-to-rear direction. Six of the slits 231 are formed.

The motor 24 is rotated to rotate the suction fan 25 for generating a suction force capable of sucking in dust with air. The motor 24 is rotated by power supplied from the battery 100. The motor 24 is connected to the suction fan 25 via an output shaft. In the rear housing 21, the motor 24 is disposed on the rear side of the suction fan 25.

The suction fan 25 generates a suction force capable of sucking in dust with air, when the motor 24 is rotated. The suction fan 25 generates a flow of air capable of sucking in dust with air. In the rear housing 21, the suction fan 25 is disposed on the front side of the motor 24. The suction fan 25 is connected to the rotation shaft of the motor 24. The suction fan 25 is rotated when the motor 24 is rotated. When the suction fan 25 is rotated, air is sucked into the front housing 22 from the suction nozzle 40.

The filter 26 removes dust contained in the sucked in air. The filter 26 is formed in a tubular shape in which one of the end parts is opened and the other end part is closed. The filter 26 is housed inside the front housing 22. More particularly, in the front housing 22, the filter 26 is disposed on the rear side of the suction nozzle 40. The filter 26 is disposed on the front side of the suction fan 25. The opening of the filter 26 faces the +X side of the suction fan 25. The filter 26 lets the air that is sucked in from the suction nozzle 40 pass through, and accumulates the dust contained in the air inside the front housing 22. The air that has passed through the filter 26 passes through the rear housing 21, and is discharged from the exhaust port 23. In a state in which the front housing 22 is detached from the rear housing 21, it is possible to mount and remove the filter 26.

The handle 30 is a holding part to be held by a user. The handle 30 is disposed at the rear part of the main body 20 on the −X side, and at the upper part of the main body 20 on the +Z side. The handle 30 includes a handle housing 31, a battery mounting housing 32, and a strap 33.

The handle housing 31 defines the external shape of the handle 30. The handle housing 31 has an opening 311, an opening 312, and an engagement member 313. In the opening 311, a trigger operation member (first switch member) 61 of the trigger switch 60 is disposed. In the opening 312, a slide operation member (second switch member) 71 of the slide switch 70 is disposed. The engagement member 313 positions the slide operation member 71.

The opening 311 is disposed at the front part of the handle housing 31 on the +X side, and at the lower part of the handle housing 31 on the −Z side.

The opening 312 is disposed at the front part of the handle housing on at the +X side, and at the upper part of the handle housing 31 on the +Z side. The opening 312 is disposed opposite to the opening 311.

The engagement member 313 is disposed inside the handle housing 31. The engagement member 313 is disposed in the lower part of the opening 312 on the +Z side. The engagement member 313 is formed in a V-shape bent in a convex shape in the upward direction, when viewed in the Y-axis direction. An upper end surface 313F of the engagement member 313 positions the slide switch 70.

The suction nozzle 40 is a suction port that sucks in dust with air into the front housing 22. The suction nozzle 40 communicates the outside and the inside of the front housing 22. The suction nozzle 40 is disposed at the front end part of the front housing 22. The suction nozzle 40 sucks the outside air into the front housing 22, when the suction fan 25 is rotated.

The battery mounting part 50 will now be described. The battery mounting part 50 is disposed below the handle 30. The battery 100 is attachable to and detachable from the battery mounting part 50. The battery mounting part 50 includes a mounting surface 50F onto which the battery 100 is mounted. The battery mounting part 50 includes a battery mounting housing 32 connected below the handle housing 31.

The mounting surface 50F includes a lower surface of the battery mounting part 50 that faces downward. The battery mounting part 50 includes a connection terminal. The connection terminal is disposed close to a guide rail that is disposed on the mounting surface 50F of the battery mounting part 50.

The battery 100 is a rechargeable battery. The battery 100 supplies power to the motor 24 of the cleaner 10. The battery 100 is formed in which multiple cells are connected.

The battery 100 includes a battery terminal. The battery terminal is disposed on the upper surface of the battery 100. The battery 100 includes a protrusion part 101 that protrudes upward from the rear part of the battery 100 on the −X side.

The battery 100 is attachable to and detachable from the battery mounting part 50. When the battery 100 is to be mounted on the battery mounting part 50, the battery 100 is slid from the rear side toward the front side of the battery mounting part 50 so that the upper surface of the battery 100 faces the mounting surface 50F. By sliding the battery 100, the front part of the protrusion part 101 is abutted against the rear part of the battery mounting part 50 on the −X side. Moreover, a battery clip 102 that is projected from the upper surface of the battery 100 is provided on the upper surface of the battery 100. The battery clip 102 is biased upward by an elastic member. The battery clip 102 is inserted into a battery mounting concave part 51 provided on the rear part of the battery mounting part 50 on the −X side. Consequently, the battery 100 and the battery mounting part 50 are positioned, and the battery 100 is mounted on the battery mounting part 50.

In a state in which the battery 100 is mounted on the battery mounting part 50, the upper surface of the battery 100 faces the mounting surface 50F. Moreover, in the state in which the battery 100 is mounted on the battery mounting part 50, the battery terminal is connected to the connection terminal. Consequently, the battery 100 is connected to the terminal provided on the battery mounting part 50. The terminal is connected to a control circuit 91.

When the battery 100 is to be removed from the battery mounting part 50, a battery button 103 is operated. The battery button 103 is connected to an elastic member that biases the battery clip 102. Thus, when the battery button 103 is operated, the battery clip 102 is removed from the battery mounting concave part 51, and the battery 100 is released from the battery mounting part 50. By sliding the battery 100 in the rear direction from the battery mounting part 50, the battery 100 is removed from the battery mounting part 50.

Figure 3:
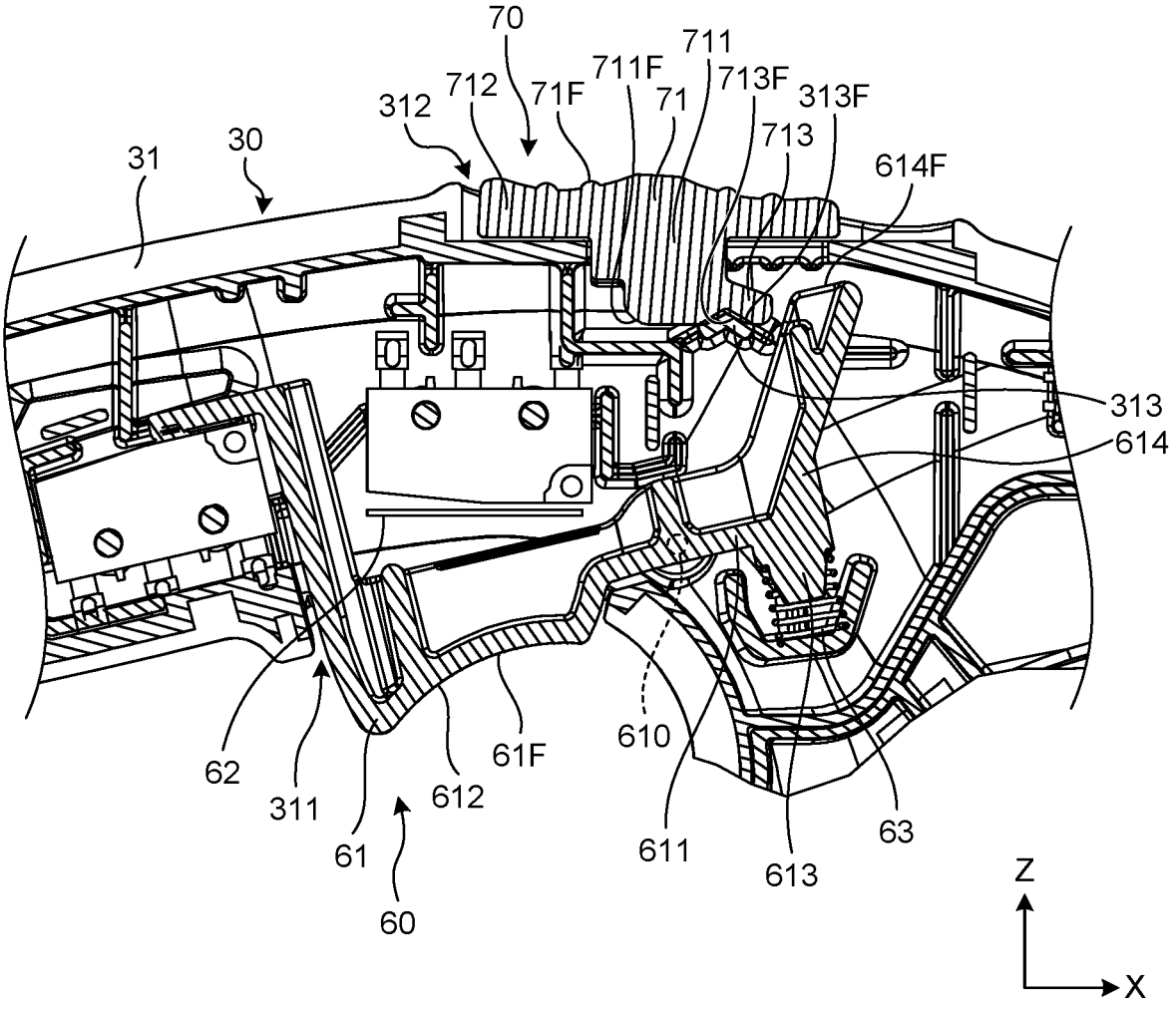
FIG. 3 is a sectional view of a trigger switch and a slide switch of the cleaner according to the first embodiment, and a diagram illustrating a state when the slide switch is placed at the rear position.
Figure 4:
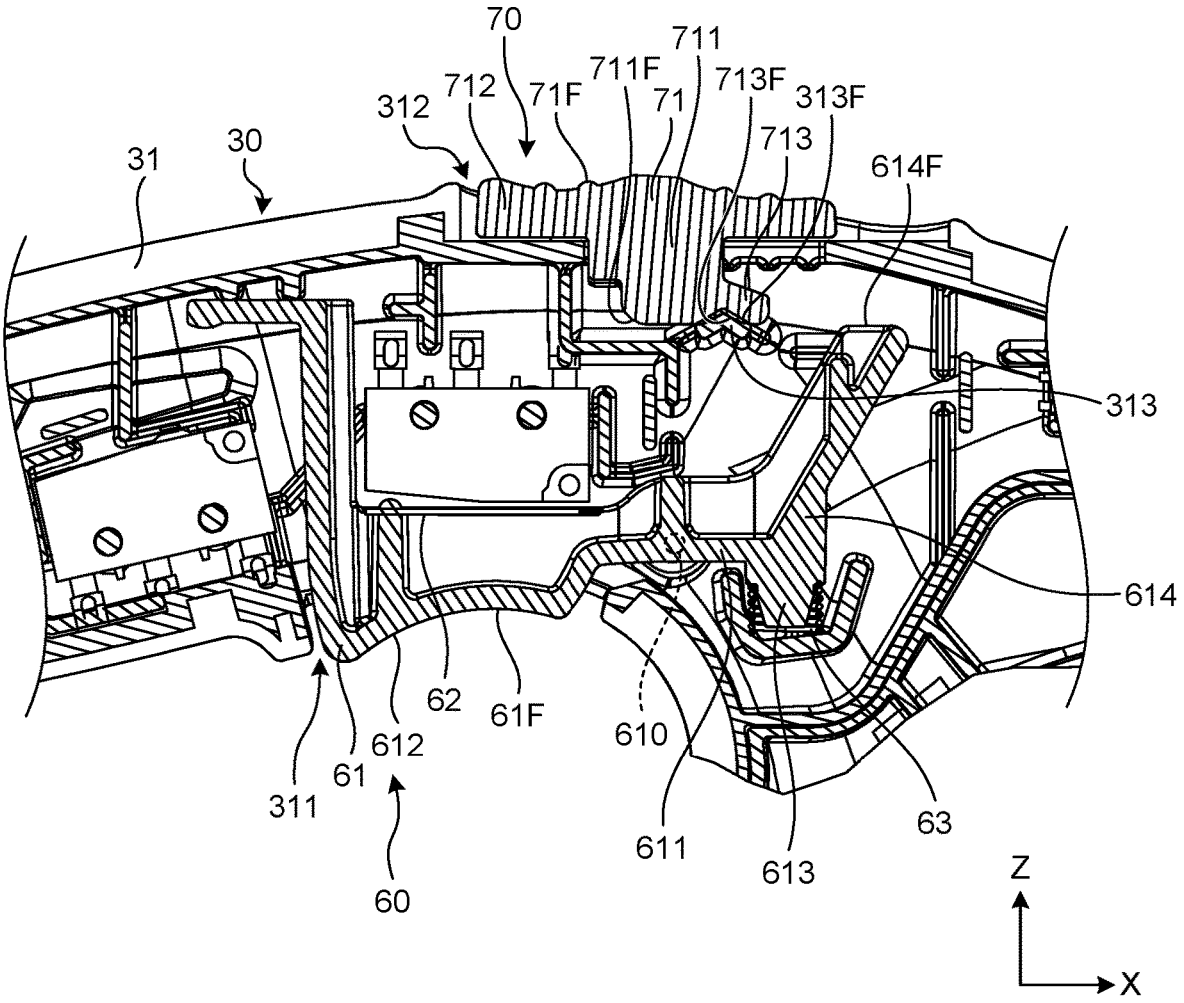

The trigger switch 60 will now be described with reference to FIG. 3 and FIG. 4. FIG. 3 is a sectional view of a trigger switch and a slide switch of the cleaner according to the first embodiment, and a diagram illustrating a state when the slide switch is placed at the rear position. FIG. 4 is a sectional view of the trigger switch and the slide switch of the cleaner according to the first embodiment, and a diagram illustrating a state when the trigger switch is pulled in. The trigger switch 60 switches between activation and deactivation of the cleaner 10 with a pull-in operation. More specifically, the trigger switch 60 switches between activation and deactivation of the motor 24 with the pull-in operation. The trigger switch 60 is disposed on the front part of the handle 30 on the +X side, and on the lower part of the handle 30 on the −Z side. The trigger switch 60 includes the trigger operation member 61, a signal output unit 62, and an elastic member 63.

The trigger operation member 61 is a member operated by a user in the trigger switch 60. The trigger operation member 61 is disposed at a position that can be operated by a finger while a user holds the handle 30 with one hand. The trigger operation member 61 is a trigger-type operation member that can be pulled into the handle 30. The trigger operation member 61 is disposed at the handle 30. More specifically, the trigger operation member 61 is disposed at a front part of the handle on the +X side, and at a lower part of the handle 30 on the −Z side. At least a part of the trigger operation member 61 is disposed in the opening 311. The trigger operation member 61 is projected downward than the lower surface of the handle housing 31. The trigger operation member 61 is a block-shaped member. The trigger operation member 61 includes a lower end surface 61F that faces downward. In the Z-axis direction, the center of the trigger operation member 61 coincides with the center of the handle 30.

The trigger operation member 61 is disposed movably with respect to the handle 30. More particularly, when the trigger operation member 61 is pulled into the opening 311, the motor 24 is switched between activation and deactivation. When a user releases his/her finger, the trigger operation member 61 returns to the original position by the elastic force of the elastic member 63.

The trigger operation member 61 includes a base part 611 on which a shaft 610 is disposed, an operation part 612, a projection part 613, and an extending part 614. The base part 611, the operation part 612, the projection part 613, and the extending part 614 are integrally formed.

The shaft 610 rotates with respect to the handle housing 31. The shaft 610 is disposed along a direction parallel to the Y-axis direction.

The base part 611 extends in the X-axis direction. The shaft 610 is disposed in the middle part of the base part 611. The base part 611 pivots around the shaft 610.

The operation part 612 is a portion operated by a user in the trigger operation member 61. The operation part 612 is formed in a block shape. The operation part 612 is disposed on the rear end part of the base part 611. At least a part of the operation part 612 is exposed from the opening 311. The lower end surface 61F is disposed on a portion exposed from the opening 311 in the operation part 612. The operation part 612 is pulled into the opening 311 or returns to the original position.

The projection part 613 is projected downward from the front end part of the base part 611. The elastic member 63 is assembled to the lower part of the projection part 613.

The extending part 614 extends in a front upward direction from the front end part of the base part 611. The extending direction of the extending part 614 is an obtuse angle with respect to the extending direction of the base part 611. The extending part 614 includes an upper end surface 614F formed in a planar shape. The upper end surface 614F is disposed parallel to the extending direction of the base part 611.

The trigger operation member 61 configured in this manner pivots around the shaft 610. When the operation part 612 is pulled into the opening 311, the trigger operation member 61 pivots around the shaft 610 in the clockwise direction, and the projection part 613 and the extending part 614 move downward. When the operation part 612 is returned to the original position, the trigger operation member 61 pivots around the shaft 610 in the counterclockwise direction, and the projection part 613 and the extending part 614 move upward.

The signal output unit 62 includes an electronic circuit capable of outputting a trigger signal by operating the trigger operation member 61. The signal output unit 62 is disposed inside the handle housing 31. The trigger signal is a command signal for activating the motor 24. More particularly, when the trigger operation member 61 is pulled in, the signal output unit 62 outputs a command signal for driving the motor 24. When the trigger operation member 61 is returned to the original position, the signal output unit 62 stops outputting the command signal for driving the motor 24.

The elastic member 63 applies an elastic force for making the pulled-in trigger operation member 61 return to the original position.

As illustrated in FIG. 3, when the trigger operation member 61 is projected from the opening 311, the trigger operation member 61 is separated from the signal output unit 62. Because the signal output unit 62 does not output the trigger signal, the cleaner 10 is deactivated.

As illustrated in FIG. 4, when the trigger operation member 61 is pulled into the opening 311, the trigger operation member 61 pivots around the shaft 610 in the clockwise direction, and the trigger operation member 61 comes into contact with the signal output unit 62. Consequently, the signal output unit 62 outputs the trigger signal, and the cleaner 10 is operated.

In the state illustrated in FIG. 4, when a user releases his/her finger from the trigger operation member 61, the trigger operation member 61 pivots around the shaft 610 in the counterclockwise direction by the elastic force of the elastic member 63. Thus, the trigger operation member 61 is separated from the signal output unit 62. Consequently, the signal output unit 62 stops outputting the trigger signal, and the cleaner 10 is deactivated.

The slide switch 70 switches between activation and deactivation of the cleaner 10 with a slide operation. More particularly, the slide switch 70 switches between activation and deactivation of the motor 24 with the slide operation. The slide switch 70 is disposed at the front part of the handle 30 on the +X side, and at the upper part of the handle 30 on the +Z side. The slide switch 70 includes the slide operation member 71.

The slide operation member 71 is a member operated by a user in the slide switch 70. The slide operation member 71 is disposed at a position that can be operated by a finger while a user holds the handle 30 with one hand. The slide operation member 71 is disposed at a position that can be operated by a finger different from a finger that operates the trigger operation member 61, while a user holds the handle 30 with one hand and without changing the holding hand. The slide operation member 71 is a slide operation member that is slidable with respect to the handle 30. The slide operation member 71 is disposed movably on the handle 30. More particularly, the slide operation member 71 is disposed at the front part of the handle 30 on the +X side, and at the upper part of the handle 30 on the +Z side. At least a part of the slide operation member 71 is disposed in the opening 312. The slide operation member 71 is projected upward than the upper surface of the handle housing 31. The slide operation member 71 includes an upper end surface 71F that faces upward. In the Z-axis direction, the center of the slide operation member 71 coincides with the center of the handle 30.

The slide operation member 71 moves the trigger operation member 61 by being moved, so as to switch between supplying and not supplying power to the motor 24. More particularly, the slide operation member 71 is slid inside the opening 312 in the X-axis direction so as to cause the trigger operation member 61 to pivot and switch between activation and deactivation of the motor 24. More particularly, when being slid toward the +X side that is a first direction, the slide operation member 71 locks the trigger operation member 61 in a state in which the trigger operation member 61 is pulled into the handle 30, and activates the motor 24. The slide operation member 71 includes a lock mechanism for maintaining the slide operation member 71 at a predetermined position up to which the slide operation member 71 is slid on the +X side. When being slid toward the −X side that is a second direction, the slide operation member 71 releases the lock of the trigger operation member 61, makes the trigger operation member 61 return to the original position, and stops the motor 24.

The slide operation member 71 includes a base part 711, an operation part 712, and a projection part 713. The base part 711, the operation part 712, and the projection part 713 are integrally formed.

The base part 711 is formed in a block shape. The base part 711 is disposed inside the opening 312. The base part 711 has a tapered surface 711F disposed at the rear part on the −X side and at the lower part on the −Z side.

The tapered surface 711F is an inclined plane inclined from above to below as going from the rear toward the front. The tapered surface 711F functions as a lock mechanism of the slide operation member 71. More particularly, by being engaged with the upper end surface 313F of the engagement member 313, the tapered surface 711F restricts the movement of the slide operation member 71 toward the −X side.

The operation part 712 is a portion operated by a user in the slide switch 70. The operation part 712 is disposed at the upper part of the base part 711 on the +Z side. At least a part of the operation part 712 is exposed from the opening 312. The upper end surface 71F is disposed on a portion exposed from the opening 312 in the operation part 712.

The projection part 713 is disposed at the front part of the base part 711 on the +X side, and at the lower part of the base part 711 on the −Z side. By being engaged with the engagement member 313, the projection part 713 positions the slide switch 70. The projection part 713 has a lower end surface (engagement surface) 713F that is formed in a concave shape and that can be engaged with the upper end surface 313F of the engagement member 313.

Figure 5:
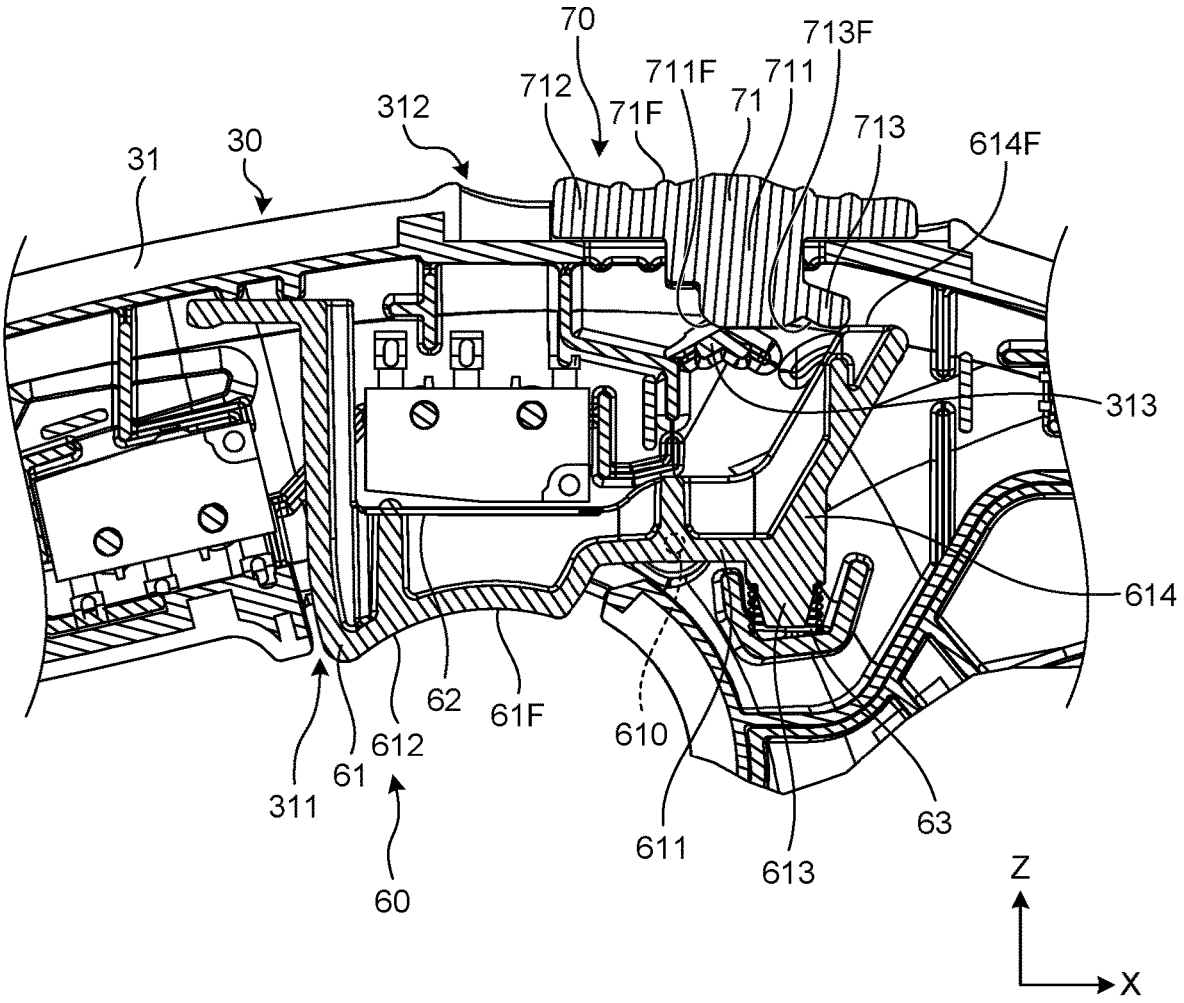
FIG. 5 is a sectional view of the trigger switch and the slide switch of the cleaner according to the first embodiment, and a diagram illustrating a state when the slide switch is placed at the middle position.
Figure 6:
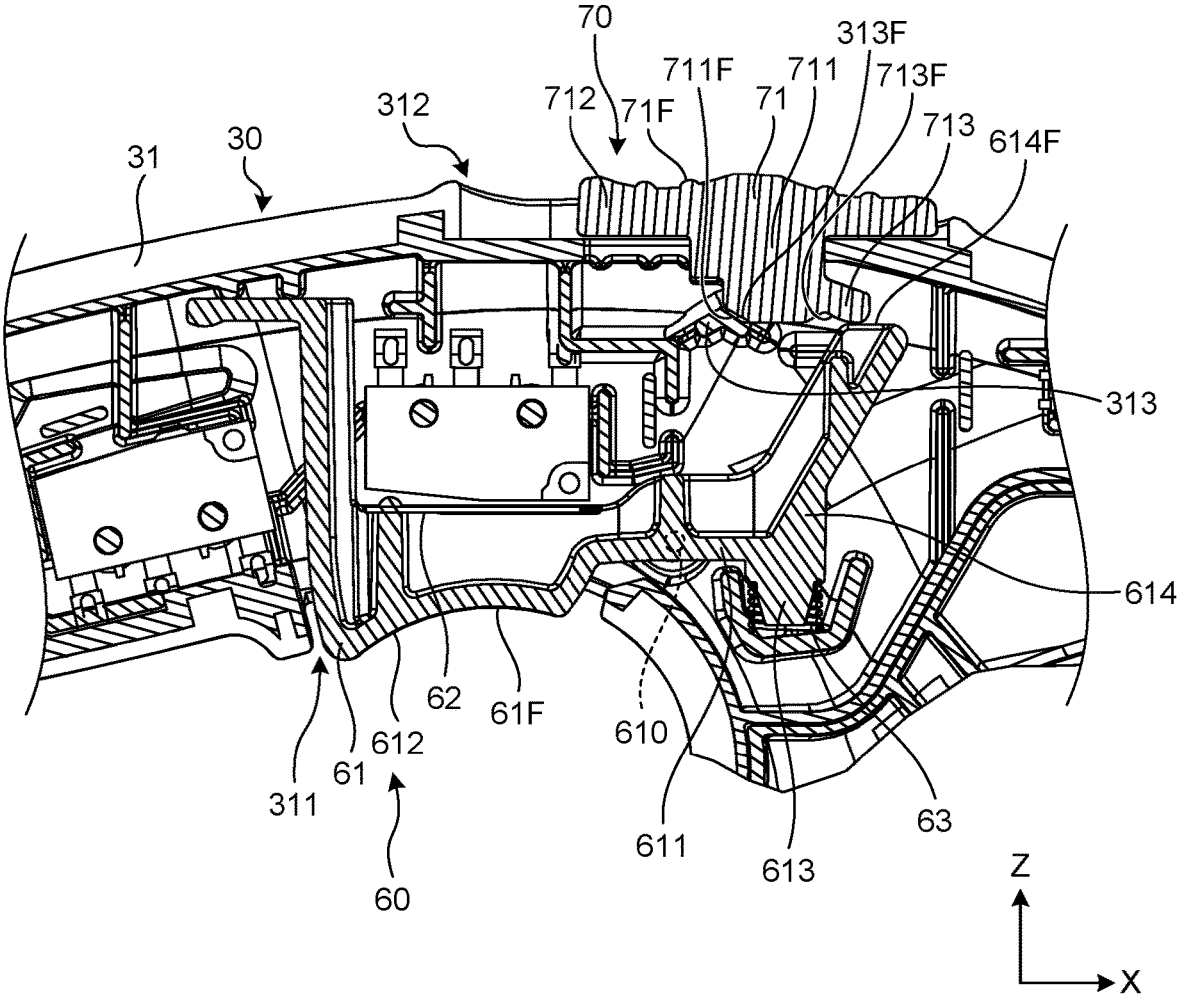
FIG. 6 is a sectional view of the trigger switch and the slide switch of the cleaner according to the first embodiment, and a diagram illustrating a state when the slide switch is placed at the front position.
Figure 7:
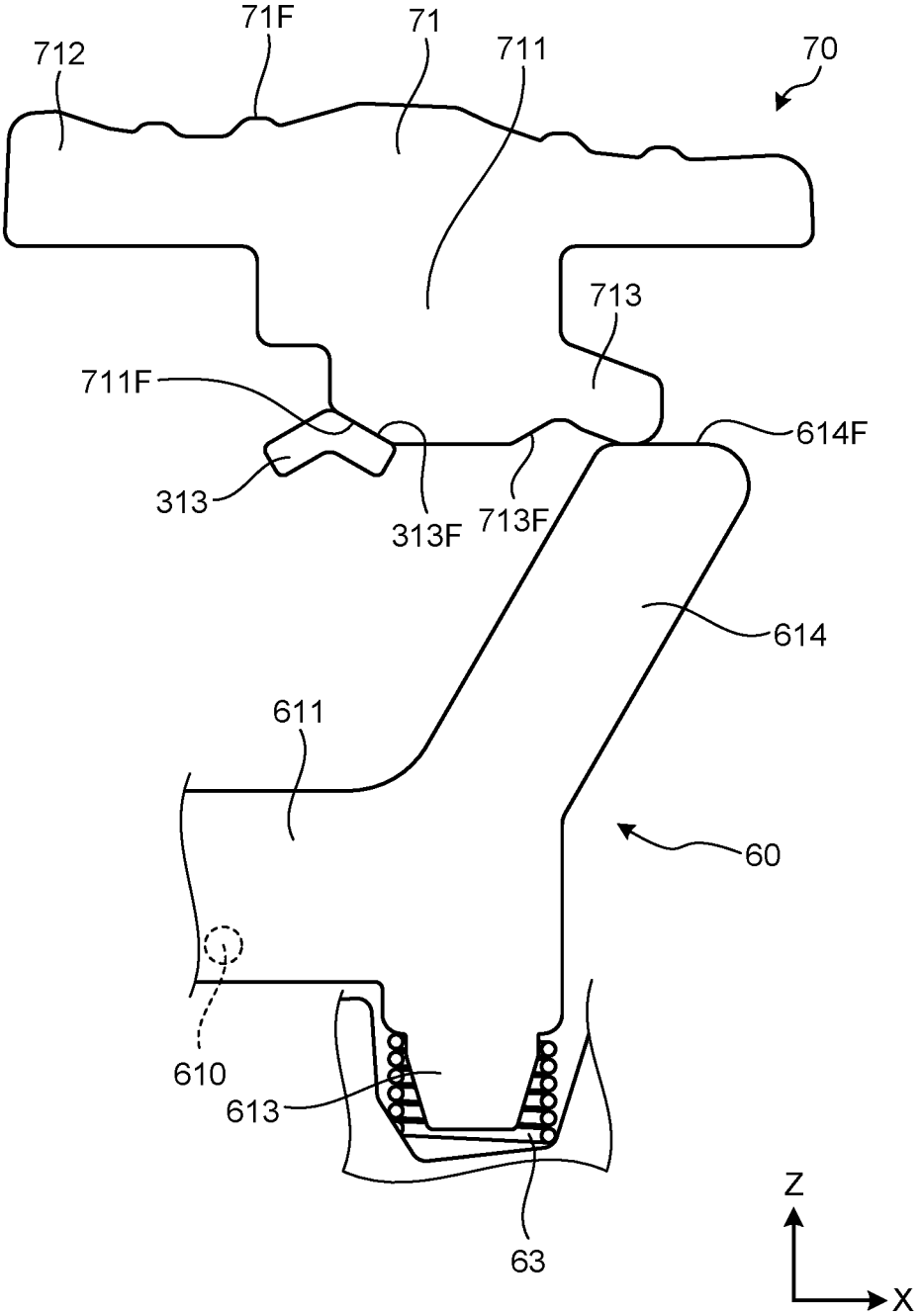
FIG. 7 is a partially enlarged view of the trigger switch and the slide switch illustrated in FIG. 6.

The slide operation of the slide switch 70 will now be described with reference to FIG. 3 and FIG. 5 to FIG. 7. FIG. 5 is a sectional view of the trigger switch and the slide switch of the cleaner according to the first embodiment, and a diagram illustrating a state when the slide switch is placed at the middle position. FIG. 6 is a sectional view of the trigger switch and the slide switch of the cleaner according to the first embodiment, and a diagram illustrating a state when the slide switch is placed at the front position. FIG. 7 is a partially enlarged view of the trigger switch and the slide switch illustrated in FIG. 6.

As illustrated in FIG. 3, when a finger is released from the trigger switch 60, and the slide switch 70 is positioned at the rear position on the −X side, the projection part 713 is separated from the extending part 614 of the trigger switch 60. Because the trigger operation member 61 is separated from the signal output unit 62, and the signal output unit 62 does not output the trigger signal, the cleaner 10 is deactivated. Moreover, the lower end surface 713F of the projection part 713 is engaged with the upper end surface 313F of the engagement member 313. Consequently, the slide switch 70 is positioned.

As illustrated in FIG. 5, when the slide switch 70 is positioned at the middle position in the X-axis direction, the projection part 713 comes into contact with the rear part on the −X side of the extending part 614 of the trigger switch 60. Consequently, the rear part on the −X side of the extending part 614 is pushed by the projection part 713, and the trigger switch 60 pivots around the shaft 610 in the clockwise direction. The trigger operation member 61 of the trigger switch 60 is pulled into the opening 311. The trigger operation member 61 comes into contact with the signal output unit 62. The signal output unit 62 outputs the trigger signal, and the cleaner 10 is operated.

As illustrated in FIG. 6 and FIG. 7, when the slide switch 70 is positioned at the front position (predetermined position) on the +X side, the projection part 713 mounts on the upper end surface 614F of the extending part 614. Moreover, the tapered surface 711F is engaged with the upper end surface 313F of the engagement member 313. Consequently, the slide switch 70 is positioned and locked at the front position on the +X side. The signal output unit 62 continuously outputs the trigger signal, and the cleaner 10 is kept operated.

As described above, the slide switch 70 is locked when the tapered surface 711F is engaged with the upper end surface 313F of the engagement member 313. At this time, a pushing force in the upward direction is applied to the extending part 614, by the elastic force of the elastic member 63. Moreover, a pushing force in the downward direction is applied to the extending part 614, by the projection part 713 mounted on the upper end surface 614F. Consequently, the slide switch 70 keeps pulling in the trigger switch 60.

In the state illustrated in FIG. 6, when the slide switch 70 is slid toward the −X side, the projection part 713 is separated from the upper end surface 614F of the extending part 614. Moreover, the tapered surface 711F is separated from the upper end surface 313F of the engagement member 313. Furthermore, when the slide switch 70 is slid toward the −X side, the projection part 713 is separated from the extending part 614 of the trigger switch 60. Then, the trigger operation member 61 is separated from the signal output unit 62, by the elastic force of the elastic member 63. The signal output unit 62 stops outputting the trigger signal, and the cleaner 10 is deactivated.

Figure 8:
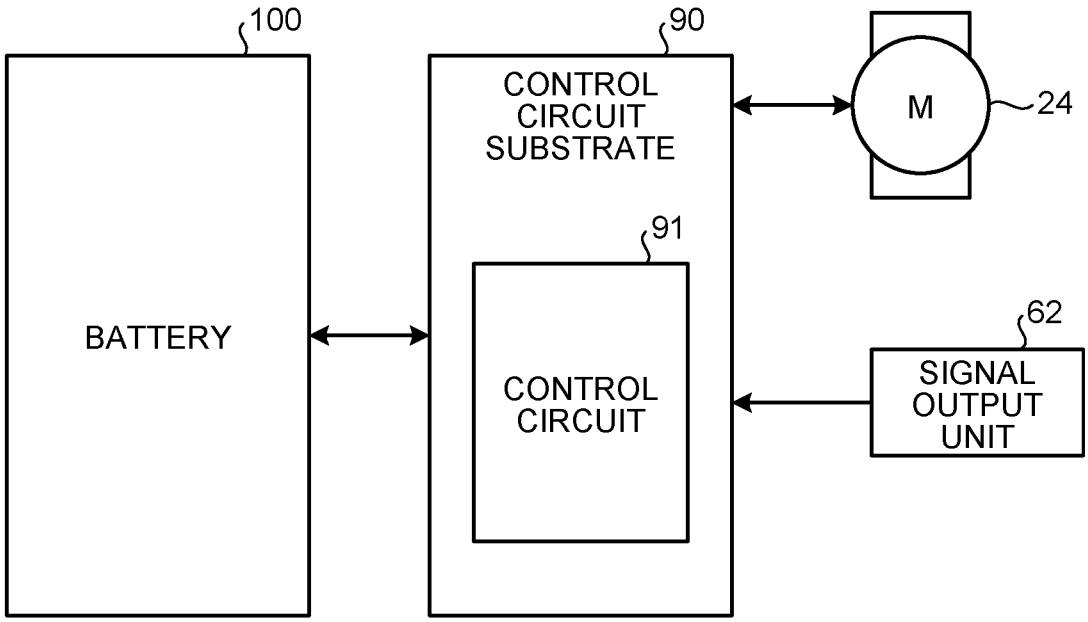
FIG. 8 is a block diagram illustrating an example of a control circuit of the cleaner according to the first embodiment.

With reference to FIG. 8, the control circuit substrate 90 will now be described. FIG. 8 is a block diagram illustrating an example of a control circuit of the cleaner according to the first embodiment. The control circuit substrate 90 is disposed inside the rear housing 21. More particularly, the control circuit substrate 90 is disposed at the rear part of the exhaust port 23 on the −X side, and at the lower part of the rear housing 21 on the −Z side. The control circuit substrate 90 includes the control circuit 91.

The control circuit 91 includes a central processing unit (CPU) that performs operation processing and a memory that stores therein a computer program. The control circuit 91 rotates the motor 24 and discharges the battery 100 according to the control program stored in the memory.

When the trigger switch 60 is pulled in while the motor 24 is being stopped, or when the slide switch 70 is slid toward the +X side so that the trigger switch 60 is pulled in, the control circuit 91 rotates the motor 24. More particularly, the control circuit 91 supplies discharge current from the battery 100 to the motor 24.

When the trigger switch 60 is returned to the original position while the motor 24 is rotated, or when the slide switch 70 is slid toward the −X side so that the trigger switch 60 is returned to the original position, the control circuit 91 stops supplying the discharge current from the battery 100, and stops the rotation of the motor 24.

Next, the usage and function of the cleaner 10 will be explained.

For example, for the partial suction, while a user holds the handle 30 with one hand, the user pulls in the trigger operation member 61 of the trigger switch 60 by his/her thumb, so as to activate the cleaner 10. While the user keeps pulling in the trigger operation member 61 by his/her finger, the trigger operation member 61 comes into contact with the signal output unit 62, and the cleaner 10 is operated. To stop the suction, the user releases his/her finger from the trigger operation member 61. The trigger operation member 61 returns to the original position, by the elastic force of the elastic member 63. Consequently, the trigger operation member 61 is separated from the signal output unit 62, and the cleaner 10 is deactivated.

For example, for the continuous suction, while the user holds the handle 30 with one hand, the user slides the slide operation member 71 of the slide switch 70 toward the front on the +X side by his/her forefinger so as to activate the cleaner 10

As illustrated in FIG. 5, when the slide switch 70 is slid to the middle position toward the +X side, the projection part 713 pushes the rear part at the −X side of the extending part 614, and the trigger switch 60 pivots around the shaft 610 in the clockwise direction. Consequently, the operation part 612 of the trigger operation member 61 is pulled into the opening 311. Thus, the trigger operation member 61 comes into contact with the signal output unit 62, and the cleaner 10 is operated.

In the state illustrated in FIG. 5, when the slide switch 70 is further slid toward the +X side, as illustrated in FIG. 6 and FIG. 7, the slide switch 70 reaches the front position on the +X side. When the slide switch 70 reaches the front position on the +X side, the projection part 713 mounts on the upper end surface 614F of the extending part 614, and the tapered surface 711F comes into contact with the upper end surface 313F of the engagement member 313. Consequently, the projection part 713 pushes the upper end surface 614F of the extending part 614 that tries to return upward by the elastic force of the elastic member 63, toward the downward side. Moreover, to make the slide switch 70 move toward the −X side, a certain degree of force that allows the tapered surface 711F to climb over the concave part of the upper end surface 313F of the engagement member 313 needs to be applied. In this manner, the slide operation member 71 is positioned and locked when the tapered surface 711F is engaged with the upper end surface 313F of the engagement member 313. Because the slide switch 70 is positioned, it is possible to restrict the slide switch 70 from unintentionally sliding toward the −X side. Hence, the trigger operation member 61 is pulled into the opening 311, and the trigger operation member 61 is locked while the trigger operation member 61 is brought into contact with the signal output part 62. The signal output unit 62 continuously outputs the trigger signal, and the cleaner 10 is kept operated.

To finish the continuous suction, while the user holds the handle 30 with one hand, the user slides the slide operation member 71 of the slide switch 70 toward the −X side by his/her thumb, so as to deactivate the cleaner 10 by.

In the states illustrated in FIG. 6 and FIG. 7, when the slide switch 70 is slid toward the −X side, as illustrated in FIG. 5, the slide switch 70 reaches the middle position on the −X side. This is a state when the projection part 713 is brought into contact with the rear part of the extending part 614 on the −X side. Moreover, the lower end surface of the base part 711 mounts on the engagement member 313, and moves toward the −X side while bending the members disposed around the engagement member 313.

In the state illustrated in FIG. 5, when the slide switch 70 is further slid toward the −X side, as illustrated in FIG. 3, the slide switch 70 reaches the rear position on the −X side. The projection part 713 is separated from the extending part 614, and the trigger operation member 61 returns to the original position by the elastic force of the elastic member 63. Because the trigger operation member 61 is separated from the signal output unit 62, the cleaner 10 is deactivated. Moreover, the lower end surface 713F of the projection part 713 is engaged with the upper end surface 313F of the engagement member 313. Consequently, the slide switch 70 is positioned, and the slide switch 70 is restricted from unintentionally sliding toward the +X side.

In this manner, while the cleaner 10 is being deactivated, the cleaner 10 is activated in the same way as when the trigger switch 60 is pulled in by a finger, by sliding the slide switch 70 toward the +X side. After the cleaner 10 is activated by sliding the slide switch 70 toward the +X side, the cleaner 10 is deactivated in the same way as when the finger is released from the trigger switch 60, by sliding the slide switch 70 toward the −X side.

As described above, in the present embodiment, while the cleaner 10 is deactivated, the cleaner 10 can be activated in the same way as when the trigger switch 60 is pulled in by a finger, by sliding the slide switch 70 toward the +X side. In the present embodiment, after the cleaner 10 is activated by sliding the slide switch 70 toward the +X side, the cleaner 10 can be deactivated in the same way as when the finger is released from the trigger switch 60, by sliding the slide switch 70 toward the −X side. With the present embodiment, it is possible to activate or deactivate the cleaner 10 in the same way as when the trigger switch 60 is operated, by sliding the slide switch 70 along the X-axis direction. Thus, with the present embodiment, the continuous suction is possible with the slide switch 70, without keep pulling the trigger switch 60 by a finger.

Moreover, in the present embodiment, for the partial suction, the user can pull in the trigger switch 60 by his/her finger. With the present embodiment, the user can easily and conveniently operate the cleaner.

In the present embodiment, the trigger switch 60 is kept pulled in. Consequently, for example, the user need not carry out an additional operation of operating a lock member, after pulling in the trigger switch 60. With the present embodiment, the trigger switch 60 is kept pulled in with a single operation.

In the present embodiment, the cleaner 10 is moved in the same way as when the trigger switch 60 is pulled in, by sliding the slide switch 70 toward the +X side. In the present embodiment, the trigger switch 60 is always pulled in when the cleaner 10 is activated. Consequently, the user can use the cleaner 10 without a sense of discomfort.

In the present embodiment, when the slide switch 70 reaches the front position on the +X side, the slide operation member 71 is positioned and locked, because the tapered surface 711F is engaged with the upper end surface 313F of the engagement member 313. Consequently, the present embodiment can restrict the slide switch 70 from unintentionally sliding toward the −X side. In other words, in the present embodiment, the trigger operation member 61 is pulled into the opening 311, and the trigger operation member 61 can be locked without fail while the trigger operation member 61 is brought into contact with the signal output unit 62.

In the present embodiment, when the slide switch 70 reaches the rear position on the −X side, the slide switch 70 of the slide operation member 71 is positioned, because the lower end surface 713F of the projection part 713 is engaged with the upper end surface 313F of the engagement member 313. Consequently, in the present embodiment, the slide switch 70 is restricted from unintentionally sliding toward the +X side.

In the present embodiment, the control circuit substrate 90 is disposed at the rear part of the exhaust port 23 on the −X side, and at the lower part of the rear housing 21 on the −Z side. With the present embodiment, it is possible to smoothly pass the air that has passed through the inside of the rear housing 21 and that is discharged from the exhaust port 23. Consequently, the present embodiment can improve the dust collection performance. Moreover, the present embodiment can effectively cool the motor 24.

Figure 11:
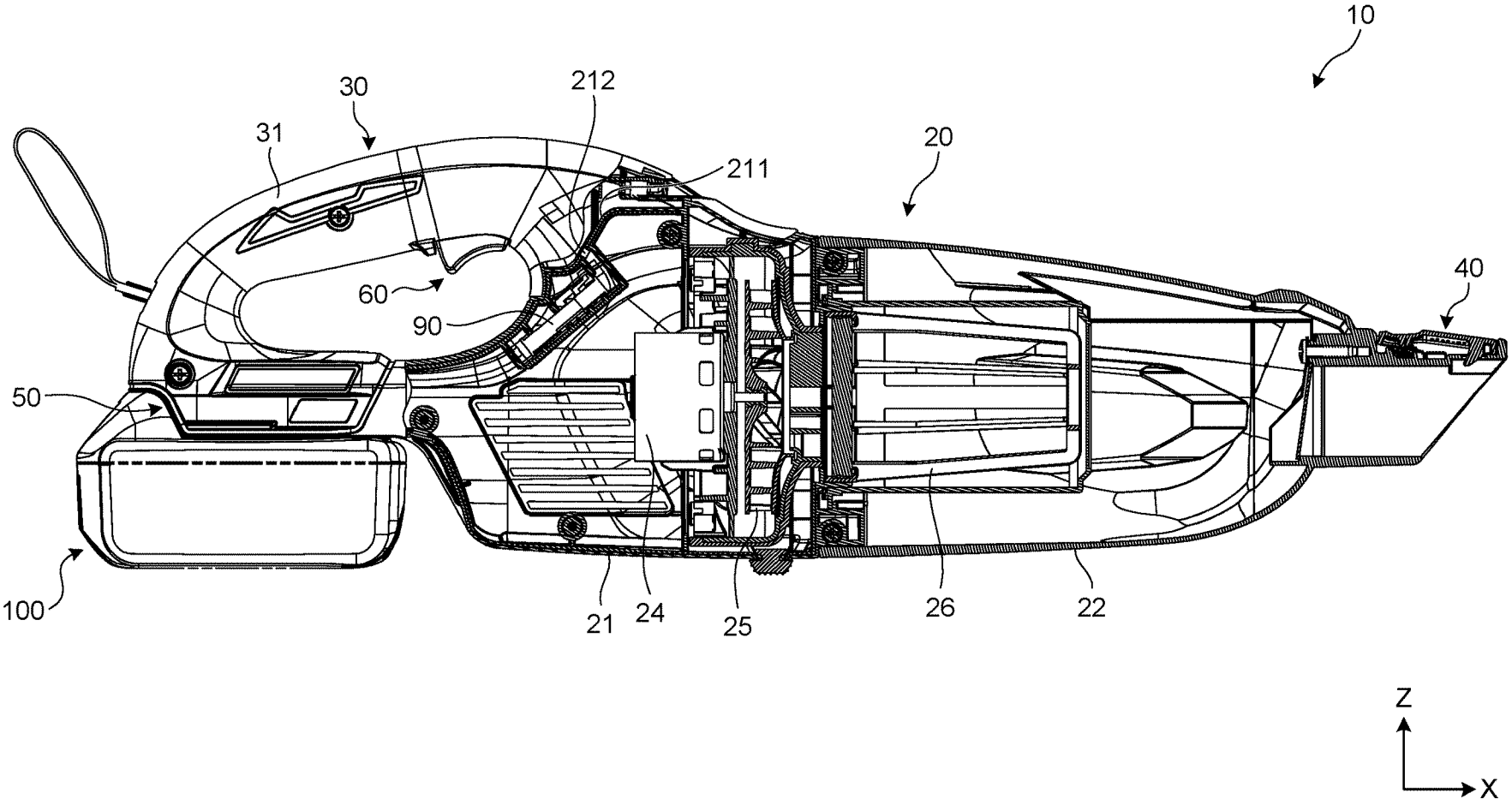
FIG. 11 is a sectional view of an example of a conventional cleaner.

In contrast, an arrangement of the conventional control circuit substrate 90 will now be described with reference to FIG. 11. FIG. 11 is a sectional view of an example of a conventional cleaner. Conventionally, the control circuit substrate 90 is disposed in the rear of the motor 24 on the −X side, and above the motor 24 on the +Z side. Moreover, a slit 212 for passing the wiring between the control circuit substrate 90 and the switch is formed on a partition wall 211 that is disposed between the upper part of the motor 24 on the +Z side and the handle 30.

In the present embodiment, the control circuit substrate 90 is disposed at the rear part of the exhaust port 23 on the −X side, and at the lower part of the rear housing 21 on the −Z side. Consequently, the wiring between the control circuit substrate 90 and the switch may be disposed so as to pass through the rear side of the handle housing 31 on the −X side and the battery mounting housing 32. When wiring is carried out in this manner, there is no need to form a slit on the partition wall 211.

Thus, the inside of the handle housing 31 in which the switch and wiring are housed, and the inside of the rear housing 21 in which the filter 26 is disposed may be each formed into an individual space. With the present embodiment, it is possible to restrict the air from flowing into the handle housing 31 from the inside of the rear housing 21. Consequently, it is possible to improve the dust collection performance. Moreover, with the present embodiment, it is further possible to restrict dust that cannot be collected by the filter 26 from flowing toward the handle 30 side without fail.

Second Embodiment

Figure 9:
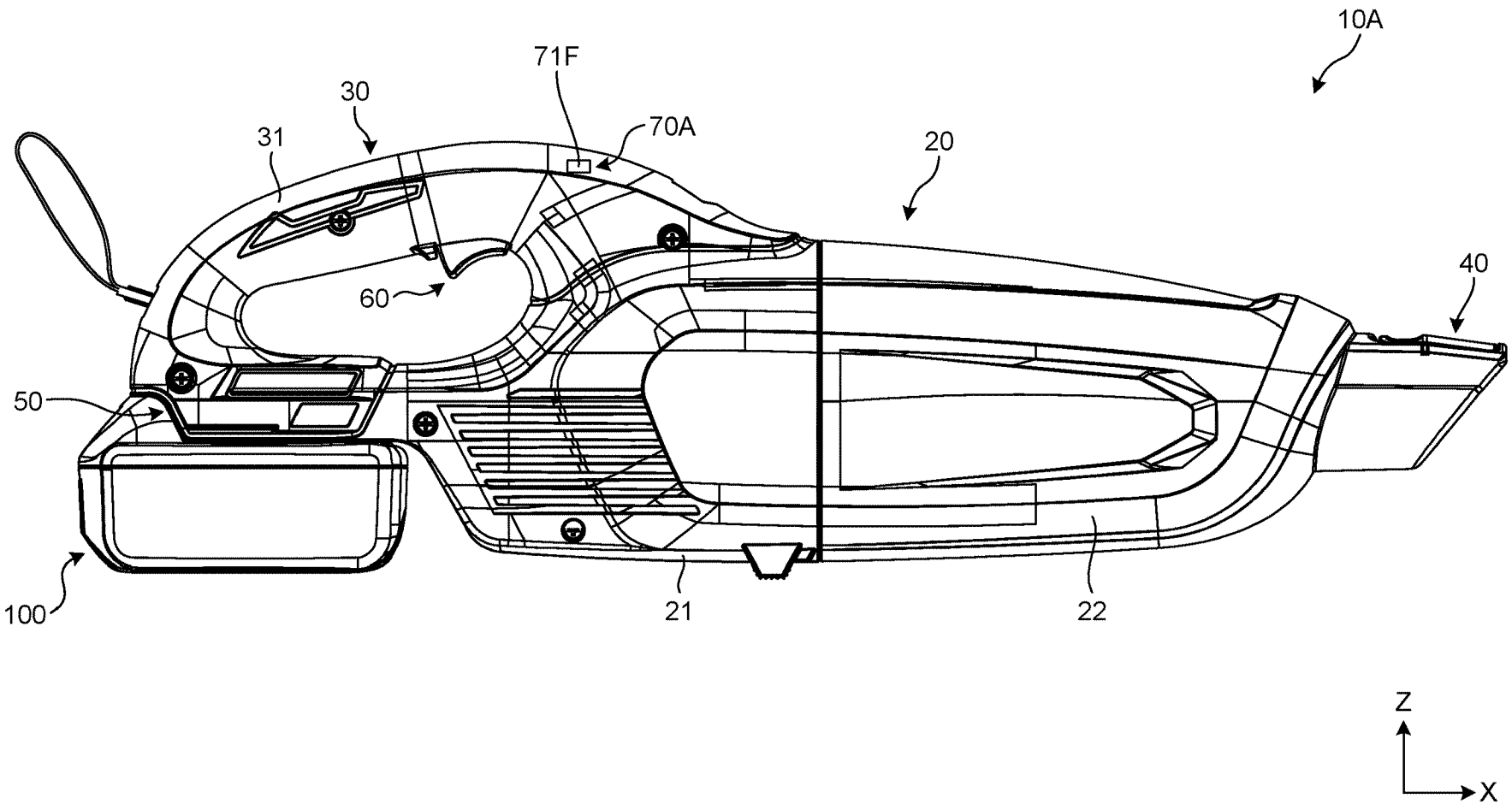
FIG. 9 is a side view of an example of a cleaner according to a second embodiment.
Figure 10:
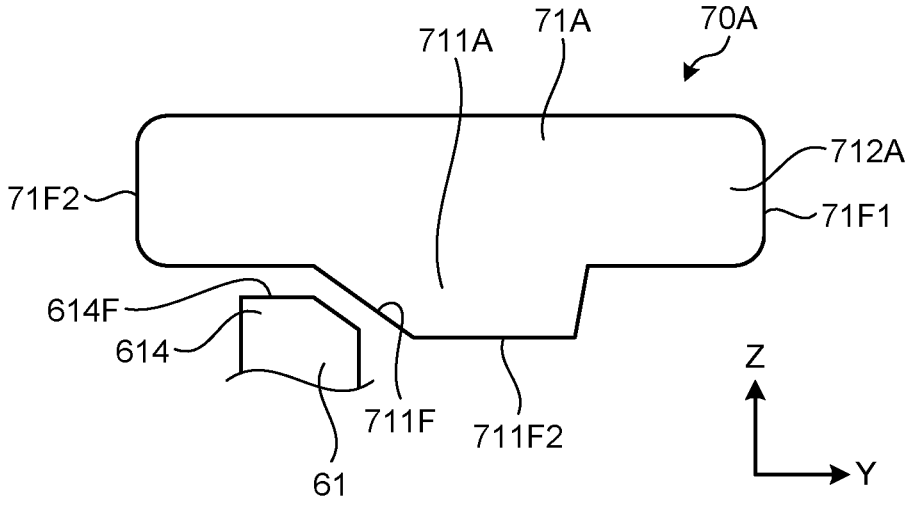
FIG. 10 is a partially enlarged view of the trigger switch and the slide switch illustrated in FIG. 9.

A cleaner 10A according to the present embodiment will now be described with reference to FIG. 9 and FIG. 10. FIG. 9 is a side view of an example of a cleaner according to a second embodiment. FIG. 10 is a partially enlarged view of the trigger switch and the slide switch illustrated in FIG. 9. The basic structure of the cleaner 10A is the same as that of the cleaner 10 of the first embodiment. In the following explanation, the same reference numerals or corresponding reference numerals denote the same components as those of the cleaner 10, and the detailed description thereof will be omitted. In the present embodiment, the structure of a slide switch 70A is different from that of the first embodiment.

A slide operation member 71A of the slide switch 70A is a member that extends in the Y-axis direction. The slide operation member 71A penetrates through the handle housing 31 in the Y-axis direction. An end part on the +Y side and an end part on the −Y side of the slide operation member 71A are projected from the handle housing 31.

The slide operation member 71A is slid in the Y-axis direction so as to cause the trigger operation member 61 to pivot and switch between activation and deactivation of the motor 24. More particularly, when being slid toward the −Y side that is a first direction, the slide operation member 71A locks the trigger operation member 61 in a state in which the trigger operation member 61 is pulled into the handle 30, and activates the motor 24. When being slid toward the +Y side that is a second direction, the slide operation member 71A makes the trigger operation member 61 return to the original position, and stops the motor 24.

The slide operation member 71A includes a base part 711A, and an operation part 712A. The base part 711A and the operation part 712A are integrally formed.

The base part 711A is disposed in the handle housing 31. The base part 711A has the tapered surface 711F disposed at the rear part on the −Y side, and at the lower part on the −Z side. The tapered surface 711F is an inclined plane inclined from below to above as going from the +Y side toward the −Y side.

The operation part 712A is a portion operated by a user in the slide switch 70A. The operation part 712A is disposed at the side part on the +Y side and the −Y side of the base part 711A. In the operation part 712A, the end surface 71F1 is disposed on a portion exposed from the +Y side of the handle housing 31. In the operation part 712A, an end surface 71F2 is disposed at a portion exposed from the −Y side of the handle housing 31.

When the slide switch 70A configured in this manner is positioned on the +Y side, the tapered surface 711F is separated from the upper end surface 614F of the extending part 614. When the end surface 71F1 is pushed toward the −Y side, the slide switch 70A is moved while the tapered surface 711F is mounted on the upper end surface 614F of the extending part 614. When the slide switch 70A is positioned on the −Y side, a lower surface 711F2 is mounted on the upper end surface 614F of the extending part 614. Consequently, the trigger switch 60 pivots in the clockwise direction. Thus, the trigger operation member 61 is pulled in, and the cleaner 10 is operated.

After the cleaner 10 is operated by the slide switch 70A, and when the end surface 71F2 is pushed toward the +Y side so that the slide switch 70A is positioned on the +Y side, the tapered surface 711F is separated from the upper end surface 614F of the extending part 614. Then, the trigger operation member 61 returns to the original position by the elastic force of the elastic member 63, and the cleaner 10 is deactivated.

As described above, in the present embodiment, the cleaner 10 can be activated and deactivated in the same way as when the trigger switch 60 is operated, by sliding the slide switch 70A along the Y-axis direction.

The configuration of the cleaner 10 described above is merely an example. For example, the slide switch 70 may also be slid in the other direction such as the Z-axis direction.

The battery 100 may be assembled so as to be attachable to and detachable from the inside or outside of the rear housing 21, or so as not to be attachable to and detachable from the inside or outside of the rear housing 21.

According to the embodiments of the present invention, it is possible to provide a cleaner that can keep pulling in the trigger-type operation switch even when a finger is released.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaner, comprising:

a main body configured to generate a suction force to suck in dust with air by a motor;

a handle on the main body and configured to be held by a user;

a first switch member that is (i) movably on the handle and (ii) configured to switch between supplying and not supplying power to the motor by being moved; and a second switch member that is (i) movably on the handle and (ii) configured to, by being moved, move the first switch member so as to switch the first switch member between the supplying and the not supplying power to the motor, wherein the first switch member is a trigger operation member capable of being pulled into the handle.

2. The cleaner according to claim 1, wherein the second switch member is a slide operation member slidable with respect to the handle.

3. The cleaner according to claim 2, wherein the first switch member and the second switch member are configured such that, when the second switch member is slid in a first direction, the second switch member pulls the first switch member into the handle, and when the second switch member is slid in a second direction opposite to the first direction, the second switch member allows the first switch member to return to an original position.

4. The cleaner according to claim 3, wherein the second switch member includes a lock mechanism for maintaining the second switch member at a predetermined position up to which the second switch member is slid in the first direction.

5. The cleaner according to claim 1, wherein the first switch member and the second switch member are each operable by a finger while holding the handle with one hand.

6. The cleaner according to claim 3, wherein the second switch member includes a projection part capable of coming into contact with the first switch member, and the first switch member, the second switch member and the projection part are configured such that, when the second switch member is slid in the first direction, the projection part comes into contact with the first switch member so as to pull the first switch member into the handle; and when the second switch member is slid in the second direction, the projection part is separated from the first switch member so as to allow the first switch member to return to the original position.

7. The cleaner according to claim 4, wherein the handle includes an engagement member that positions the second switch member, the second switch member includes a tapered surface that is on an outer peripheral surface of the second switch member and that functions as the lock mechanism, and the tapered surface is configured to restrict a movement of the second switch member, by being engaged with the engagement member.

8. The cleaner according to claim 3, wherein the handle includes an engagement member that positions the second switch member, the second switch member includes an engagement surface capable of being engaged with the engagement member, and the engagement surface is configured to restrict a movement of the second switch member, by being engaged with the engagement member in a state in which the first switch member is positioned at the original position.

9. The cleaner according to claim 3, further comprising an elastic member that biases the first switch member to return to the original position from a state being pulled into the handle, and the second direction is a direction different from a direction to which an biasing force of the elastic member is applied.

* * * * *